US012291866B2

(12) United States Patent
Moscovitch

(10) Patent No.: US 12,291,866 B2
(45) Date of Patent: May 6, 2025

(54) METHOD OF INSTALLING DRYWALL

(71) Applicant: Jerry Moscovitch, Toronto (CA)

(72) Inventor: Jerry Moscovitch, Toronto (CA)

( * ) Notice: Subject to any disclaimer, the term of this patent is extended or adjusted under 35 U.S.C. 154(b) by 269 days.

(21) Appl. No.: 17/923,078

(22) PCT Filed: May 3, 2021

(86) PCT No.: PCT/CA2021/000040
§ 371 (c)(1),
(2) Date: Nov. 3, 2022

(87) PCT Pub. No.: WO2021/223008
PCT Pub. Date: Nov. 11, 2021

(65) Prior Publication Data

US 2023/0340785 A1 Oct. 26, 2023

Related U.S. Application Data

(60) Provisional application No. 63/019,785, filed on May 4, 2020.

(51) Int. Cl.
*E04C 2/40* (2006.01)
*E04C 2/04* (2006.01)

(52) U.S. Cl.
CPC ..... *E04C 2/405* (2013.01); *E04C 2/043* (2013.01)

(58) Field of Classification Search
CPC ..... E04C 2/405; E04C 2/043; E04F 13/04; E04B 2002/728; E04B 2/723; E04B 2/7457
See application file for complete search history.

(56) References Cited

U.S. PATENT DOCUMENTS 3,090,164 A 5/1963 Nelsson
4,151,687 A * 5/1979 Kephart, Jr. ..... E04B 1/344 52/631
4,704,837 A 11/1987 Menchetti et al.
4,782,642 A 11/1988 Conville
5,279,091 A 1/1994 Williams et al.
5,311,717 A * 5/1994 Yount ..... E04F 13/04 52/741.1
5,919,545 A * 7/1999 Giezendanner ..... B32B 3/12 156/196
6,295,786 B1 * 10/2001 Lee ..... B32B 5/18 52/783.17
6,777,063 B2 * 8/2004 Born ..... B32B 5/18 428/167

(Continued)

FOREIGN PATENT DOCUMENTS

CA 2623787 A1 9/2008
DE 8128252 U1 5/1982

OTHER PUBLICATIONS

Gypsum Association, "Application and Finishing of Gypsum Panel Products", pabco.gypsum.com, 2007, GA-216-2007.

(Continued)

*Primary Examiner* — Patrick J Maestri
(74) *Attorney, Agent, or Firm* — Perry + Currier Inc.

(57) ABSTRACT

Described herein is a method of installing dry wall boards. The boards are installed to create seams that run up from the floor to the ceiling along a wall, then across the ceiling and down an opposite wall. The seams lie within a planar box of suitable thickness.

13 Claims, 20 Drawing Sheets

(56) References Cited

U.S. PATENT DOCUMENTS

| | | | | |
|---|---|---|---|---|
| 8,959,861 | B1 * | 2/2015 | Wambaugh | E04F 13/0898 52/409 |
| 2005/0257461 | A1 * | 11/2005 | Daly | E04F 19/064 52/254 |
| 2009/0165401 | A1 | 7/2009 | Smalley, III | |

OTHER PUBLICATIONS

Istockphoto, "Acrhideaphoto: Stock photo ID: 532179548. Renovation of an old house stock photo", Jun. 14, 2016, Retrieved from the Internet on Apr. 18, 2024 from URL: https://www.istockphoto.com/en/photo/renovation-of-an-old-house-gm532179548-94151569.

* cited by examiner

METHOD OF INSTALLING DRYWALL

FIELD OF THE INVENTION

The invention relates to drywall and more specifically to the installation of drywall boards to construct a room.

BACKGROUND OF THE INVENTION

In the construction of buildings, drywall boards are commonly used to build interior walls and corners. The edges of drywall boards are often tapered such that where two drywall boards abut, a cove or depression is formed. The cove is first filled with joint compound and then tape is pressed into the joint compound along the full length of the cove. More joint compound is then placed over the tape before the first sanding of the resulting joint is performed. Iterations of joint compound application and sanding are performed as needed.

The area where two boards abut at a corner is often more difficult to finish than where two boards abut along a flat portion of a wall or ceiling. At an inner (less than 180 degrees) corner, taping, joint compound application and sanding are more cumbersome. The joint application and sanding process is usually performed several times, even by an experienced and highly skilled drywall finisher, before the corner joint takes on the appearance of a cleanly, integrally formed corner area with no visually perceptible joint areas. The finishing process is especially time consuming and highly dependent upon the skill of the drywall finisher. As will be appreciated, this adds to the overall cost of constructing any structure where drywall is used and increases the time needed for drywall finishing.

The above finishing process can be particularly troublesome for home remodelling applications undertaken by "do-it-yourself" persons who do not have extensive experience in working with drywall finishing and have not acquired the necessary skill to finish inner and outer corner areas of a structure in a manner that produces clean, well-finished corner areas free from visual imperfections. Whereas the portions of adjacent drywall boards having tapered edges that meet along a flat wall or ceiling can usually be finished adequately by even a "do-it-yourself" person, the inner and outer corner areas are usually difficult and time consuming for such persons to finish.

When installing drywall to construct walls and ceilings in a room, the installer secures a first board to the wall studs or ceiling joists. In a typical room containing four walls and a ceiling, a first board might be secured to one wall and then adjoining boards are abutted thereto until one wall is spanned with drywall boards. A similar process occurs for the other walls. Finally, ceiling boards are secured to the joists to construct the drywall ceiling. In some circumstances, installers may start with the ceiling and then proceed to the walls. Or, the installation of wall and ceiling boards may alternate. The installation proceeds on an ad hoc basis.

During this process, the installer cuts boards to various sizes to fill in spaces as the procedure continues. Seams are created somewhat haphazardly where boards abut that then have to be treated with drywall compound and tape. In particular, a drywall worker applies drywall compound (sometimes referred to as "mud") to the seams. This is followed by an application of drywall tape. After the drywall compound dries, the compound is sanded. Then, more compound is applied and further sanding occurs. This cycle is repeated until the seams are hidden underneath compound and the compound is feathered out so that no build up can be seen.

The installer often has to move a ladder or scaffolding from seam to seam to accomplish this task, which is quite laborious. Tools and equipment also need to be transported to each seam. The arduous task of applying drywall tape and compound is thus made harder by the need to move tools around the room to access each drywall seam.

There is therefore a need to improve this method of drywall installation to reduce the time required to install the drywall and the skill and difficulty required to finish the drywall. In addition, it would be advantageous to reduce the amount of scrap drywall at job sites that is marked for disposal, which consequently would reduce the tremendous amount of drywall waste that ends up annually at landfills.

SUMMARY OF THE INVENTION

Described herein is a method of installing drywall in a room containing a first wall framing, an opposite second wall framing and a ceiling framing. The framing can be made of wood or metal studs or joists, for example.

A first drywall apparatus is provided having a first wall panel hingeably connected to a first ceiling panel via a first hinge. Likewise, a second drywall apparatus is provided having a second wall panel hingeably connected to a second ceiling panel via a second hinge. The first wall panel is secured to the first wall framing and the first ceiling panel to the ceiling framing. The second wall panel is secured to the second wall framing and the second ceiling panel to the ceiling framing, such that an edge of the first drywall apparatus perpendicular to the first hinge and an edge of the second drywall apparatus perpendicular to the second hinge lie within a nominal planar box of thickness two inches, which is defined below.

Other drywall boards are installed so that seams lie within respective planar boxes. Each seam runs from the floor, up the wall, across the ceiling and down the opposite wall.

Drywall compound is applied to the seams. In addition, according to the principles of the present invention, drywall tape, such as paper or fiberglass mesh, may be applied to the seams in a continuous ribbon, which is to say, without the need to cut the drywall tape into more than one piece. After more drywall compound is added and allowed to dry, sanding of the compound occurs. This process is repeated until the compound is suitably feathered so as to hide any buildup thereof.

BRIEF DESCRIPTION OF THE DRAWINGS

FIG. 4I shows drywall tape applied to seams, according to the principles of the present invention.

DETAILED DESCRIPTION OF THE INVENTION

Figure 1:
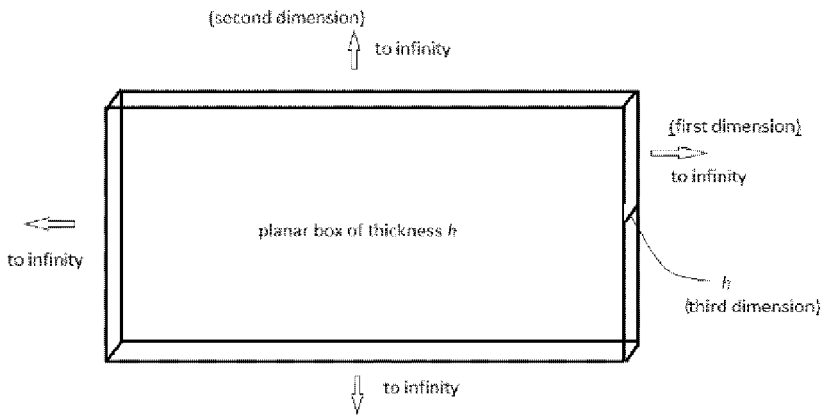
FIG. 1 shows a planar box of thickness h.

Starting from a plane in two dimensions, one can imagine giving the plane a thickness h in a direction perpendicular to the two dimensions, resulting in what will be herein referred to as a planar box of thickness h, which is shown in FIG. 1.

For greater certainty, consider an example using a three-dimensional Cartesian coordinate system, $R^3$, with axes x, y and z. The x-y plane consists of the set of points $\{(x, y, z)\in R^3 | z=0\}$. This plane extends along the positive and negative x direction without bound, and along the positive and negative y direction without bound. The set of points $\{(x, y, z)\in R^3\ 10\leq z\leq h\}$ is an example of a planar box of thickness h. Yet another way of saying the same thing is that a planar box of thickness h is a box having a first dimension, a second dimension and a third dimension that are mutually perpendicular, such that the first dimension has a length that increases without bound in both directions, the second dimension has a width that increases without bound in both directions and the third dimension has a thickness equal to h. This nominal box is a theoretical construct used herein to specify the location of certain drywall seams, as will be explained below.

Figure 2A:
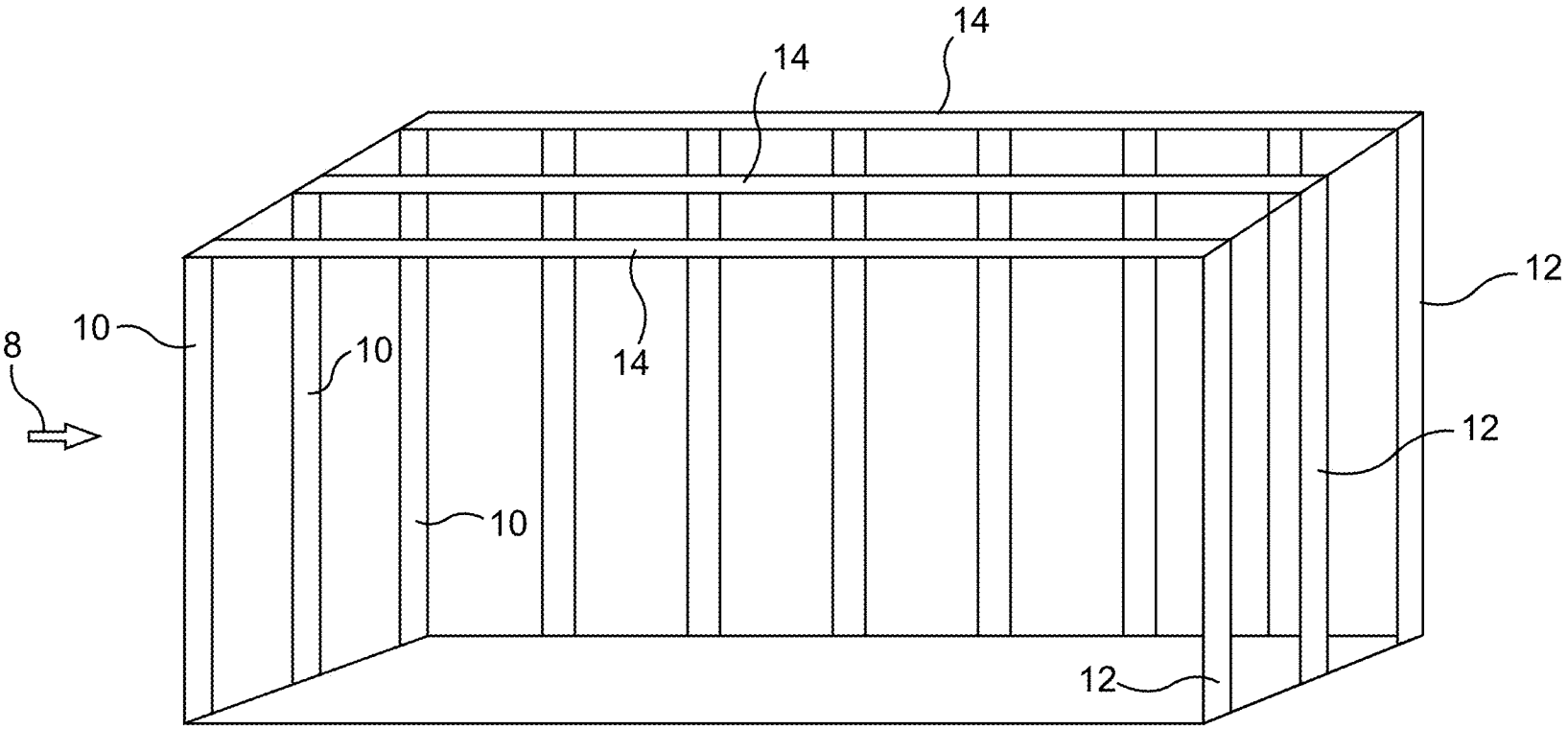
FIG. 2A shows a room with wall framing and ceiling framing suitable for drywall installation.
Figure 2B:
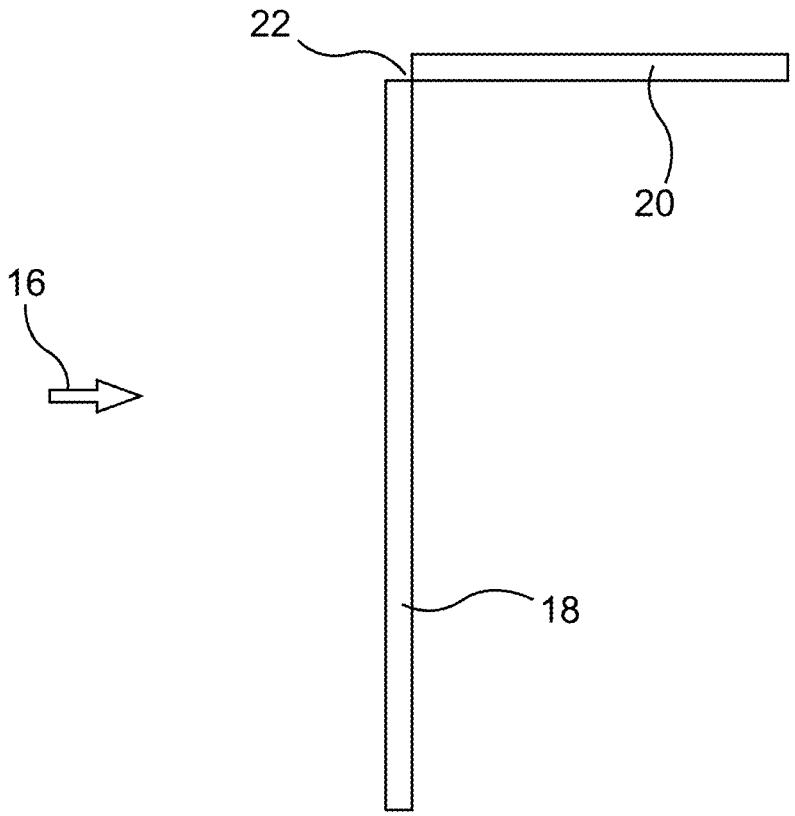
FIG. 2B shows a hinged drywall apparatus for use according to the principles of the present invention.
Figure 2C:
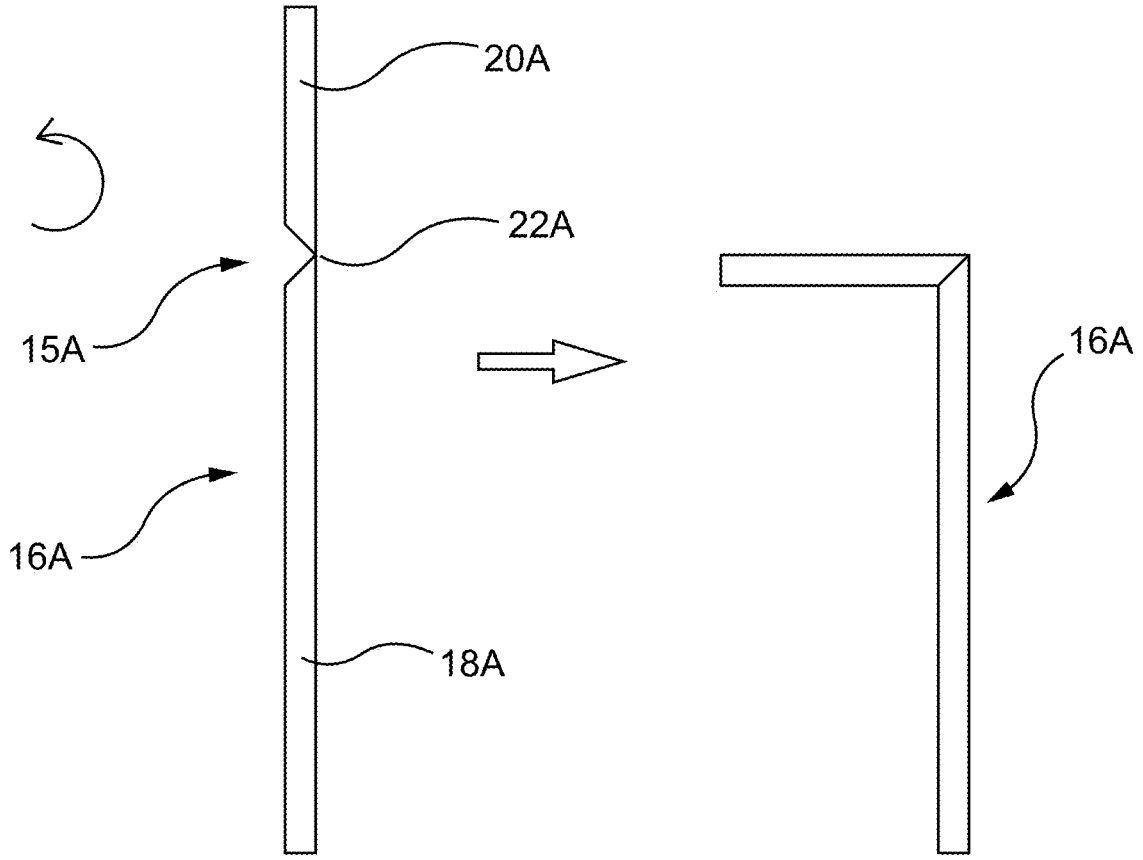
FIG. 2C shows a different embodiment of a hinged drywall apparatus for use according to the principles of the present invention.

With reference to FIGS. 2A-2C, a method of applying drywall in a room 8 containing a first wall framing 10, an opposite second wall framing 12 and a ceiling framing 14 is described. The framing could be made of wood or metal studs and joists, for example. It should be understood that the framing shown in FIG. 2A is schematic and not an actual representation of the number or relative spacing of studs/joists used in the construction of a room, which might be dictated by provincial or state building codes.

The method includes providing a first drywall apparatus 16 having a first wall panel 18 hingeably connected to a first ceiling panel 20 via a first hinge 22, as shown is side view in FIG. 2B. The first hinge 22 can be formed, for example, by scoring a line across the back of a drywall board and snapping the board along the line, being careful not to cut the drywall paper on the front face of the drywall board. In this way, the drywall paper can be creased along the line to form the hinge 22. Advantageously, because the paper along the line remains intact, there is no need to tape, mud or sand along this crease.

Alternatively, the hinge 22 can be formed by removing a thin wedge on the side of the drywall opposite the front face, again being careful not to pierce the drywall paper thereon. The drywall paper along the thin wedge becomes the hinge 22. Two panels 18, 20 are disposed on either side of the hinge 22 and can rotate about the hinge 22 to form a corner of the room 8.

With reference to FIG. 2C, if a 90-degree wedge is created 15A, the drywall apparatus 16A can be used to form an outside corner where the angle between the finishing (i.e., exposed) sheets of drywall paper (not shown in FIG. 2C) on the two panels 18A and 20B joined by a hinge 22A is 270 degrees, instead of 90 degrees for an inside corner.

In one embodiment, an inside corner is formed where a wall meets the ceiling. In such case, one panel becomes the first wall panel 18 and the second panel on the other side of the hinge 22 becomes the first ceiling panel 20.

Figure 3:
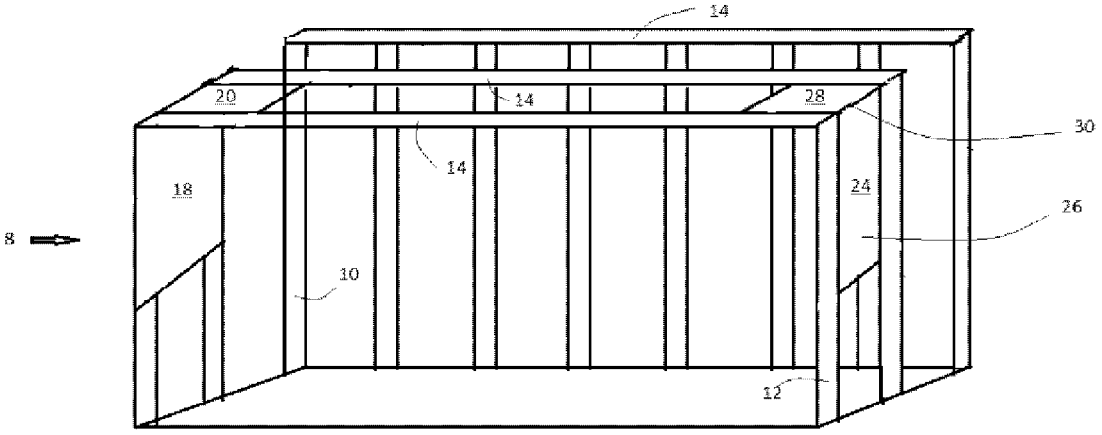
FIG. 3 shows the installation of a first drywall apparatus having a first wall panel hingeably connected to a first ceiling panel, and a second drywall apparatus having a second wall panel hingeably connected to a second ceiling panel, according to the principles of the present invention.

With reference to FIG. 3, the first drywall apparatus 16 of FIG. 2B is attached to the framing shown in FIG. 2A with drywall screws, for example. In particular, the first wall panel 18 is secured to the first wall framing 10 to form part of the wall of the room. The first ceiling panel 20 is secured to the first ceiling framing 14 to form part of the ceiling of the room. The first hinge 22, oriented horizontally, becomes the corner, where the wall meets the ceiling. Advantageously, there is no need to tape, mud or sand along this corner, since the drywall paper is intact therealong.

Opposite the first wall framing 10 is the opposite second wall framing 12. There, a second drywall apparatus 24, having a second wall panel 26 hingeably connected to a second ceiling panel 28 via a second hinge 30, is mounted with drywall screws, for example, according the principles of the present invention.

Figure 4A:
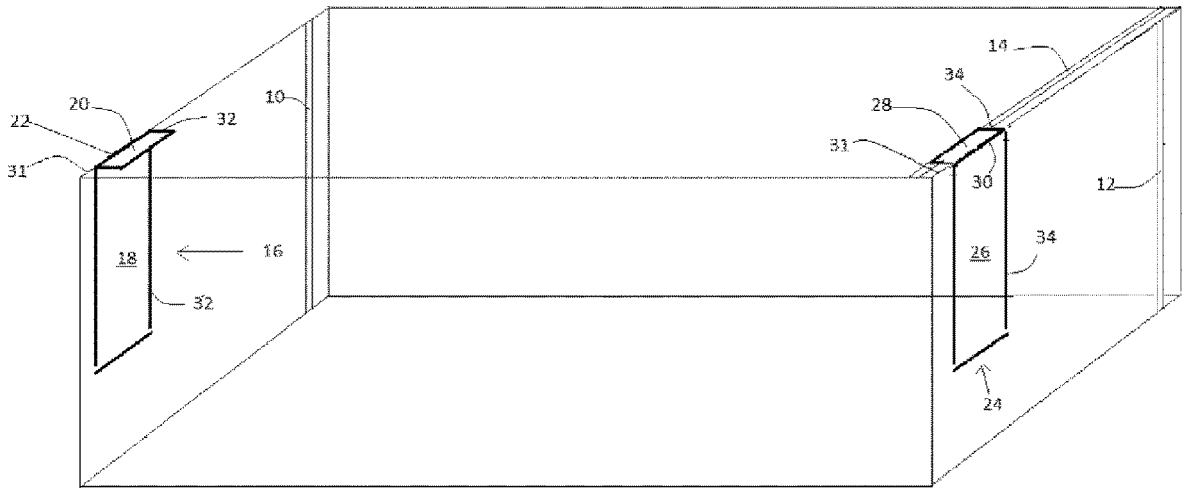
FIG. 4A shows the installation of a first drywall apparatus having a first wall panel hingeably connected to a first ceiling panel, and a second drywall apparatus having a second wall panel hingeably connected to a second ceiling panel, with both apparatuses displaced from the corners, according to the principles of the present invention.
Figure 4B:
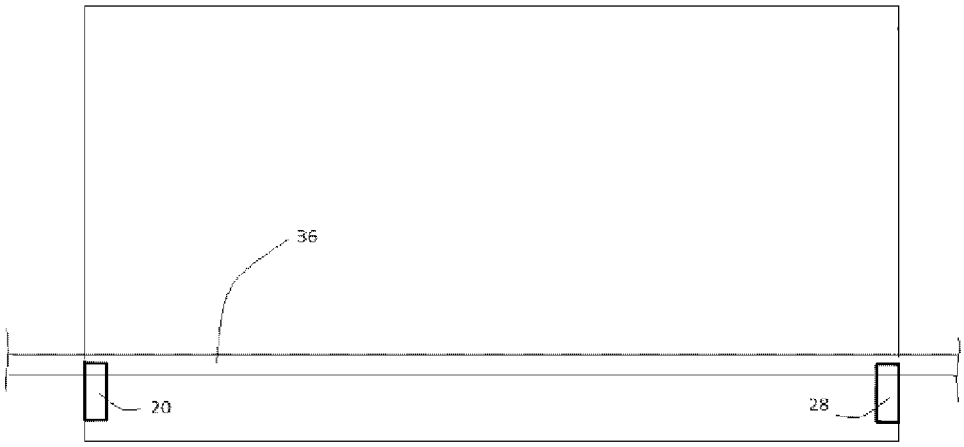
FIG. 4B shows an overhead view of the apparatuses of FIG. 4A, including a nominal planar box, according to the principles of the present invention.

Reference will now be made to FIGS. 4A-I, pertaining to a different configuration of drywall boards. In FIGS. 4A and 4B, the first drywall apparatus 16 and the second drywall apparatus 24 are displaced from their nearest corners by a corner offset 31, which can be 16 inches. Other acceptable lengths for the corner offset 31 are 12 inches or 24 inches, for example. The area of the corner offsets needs to be filled in by separate drywall boards to form "three-way" corners, which is to say corners formed by the intersection of three perpendicular planes. An example of a three-way corner is provided in U.S. Patent Application Publication No. 20190211549, which is incorporated herein by reference. For clarity, only representative studs of the first wall framing 10 and the second wall framing 12, and a representative joist of the ceiling framing 14 are shown in FIG. 4A.

The first wall panel 18 is secured to the first wall framing 10 to form part of the wall of the room. The first ceiling panel 20 is secured to the first ceiling framing 14 to form part of the ceiling of the room. The first hinge 22, oriented horizontally, becomes the corner, where the wall meets the ceiling.

Opposite the first wall framing 10 is the opposite second wall framing 12. There, the second drywall apparatus 24, having the second wall panel 26 hingeably connected to the second ceiling panel 28 via the second hinge 30, is mounted with drywall screws, for example, according the principles of the present invention.

In particular, the second wall panel 26 is secured to the second wall framing 12 and the second ceiling panel 28 to the ceiling framing 14 such that an edge 32 of the first drywall apparatus 16 perpendicular to the first hinge 22 and an edge 34 of the second drywall apparatus 24 perpendicular to the second hinge 30 lie within a nominal planar box 36 of a thickness less than or equal to two inches. This is illustrated in a top view in FIG. 4B, where the wall and ceiling framings have been omitted for clarity.

Various sizes for the first drywall apparatus 16 and second drywall apparatus 24 are possible. For example, in conformity with North American standards where wall studs are 16 inches apart on centre, in one embodiment, the wall panel is a multiple of 16 inches wide, such as 48 inches wide. Its height can range from about the full height of the wall or smaller. The ceiling panel can be 48 inches wide and 16 inches from the hinge to the opposite end. The 16-inch length is the same as the length of the corner offset 31. If the corner offset were 12 inches or 24 inches, so too would the length of the ceiling panel be as measured from the hinge to the opposite end. That is, preferably, the length of the ceiling panel, from the hinge to the opposite side, is the same as the corner offset, leaving a square gap to be filled in by the three-way corner.

Figure 4C:
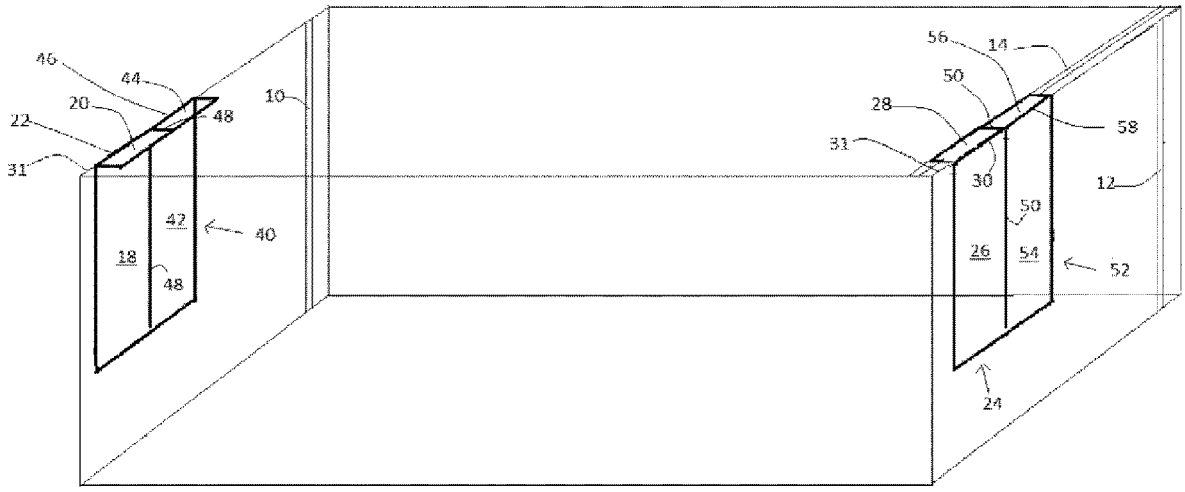
FIG. 4C shows the installation of a four-drywall apparatus having wall panels hingeably connected to ceiling panels, according to the principles of the present invention.

Seams are formed by abutting one drywall board to another. With reference to FIG. 4C, a third drywall apparatus 40 having a third wall panel 42 hingeably connected to a third ceiling panel 44 via a third hinge 46 is abutted to the first drywall apparatus 16. Specifically, the third wall panel 42 is secured to the first wall framing 10, with drywall screws, for example. Likewise, the third ceiling panel 44 is secured to the ceiling framing 14 such that the third drywall apparatus 40 abuts the edge 32 of the first drywall apparatus 16 to thereby form a first seam 48 therebetween. This first seam 48 has a part 60 formed between the first wall panel 18 and the third wall panel 42, and a part 64 formed between the first ceiling panel 20 and the third ceiling panel 44. See FIG. 4D.

In a similar fashion, a second seam 50 is formed by abutting a fourth drywall apparatus 52 to the second drywall apparatus 24. The fourth drywall apparatus 52 has a fourth wall panel 54 hingeably connected to a fourth ceiling panel 56 via a fourth hinge 58. The fourth wall panel 54 is secured to the second wall framing 12 and the fourth ceiling panel 56 is secured to the ceiling framing 14. This second seam 50 has a part 68 formed between the second wall panel 26 and the fourth wall panel 54, and a part 72 formed between the second ceiling panel 28 and the fourth ceiling panel 56.

Figure 4D:
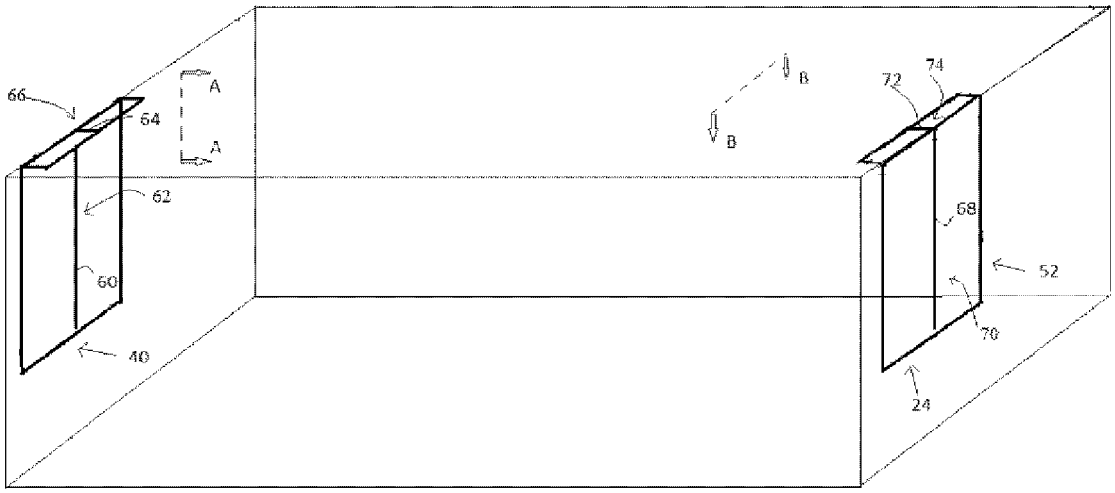
FIG. 4D shows FIG. 4C with different elements illustrated.

For clarity so as to not clutter the figure, FIG. 4C is reproduced in FIG. 4D, but with some reference numbers omitted and some new reference numbers added. The part 60 of the first seam 48, formed between the first wall panel 18 and the third wall panel 42, is located on a first wall portion 62 and the other part 64 of the first seam 48, formed between the first ceiling panel 20 and the third ceiling panel 44, is located on a first ceiling portion 66. Note that the part 60 and the other part 64 are themselves seams, lying on the wall and ceiling, respectively. That is, the first seam 48 includes a seam on the wall and a seam on the ceiling. The part 68 of the second seam 50, formed between the second wall panel 26 and the fourth wall panel 54, is located on a second wall portion 70 and the other part 72 of the second seam 50, formed between the second ceiling panel 28 and the fourth ceiling panel 56, is located on a second ceiling portion 74. Note that the part 68 and the other part 72 are themselves seams, lying on the wall and ceiling, respectively. The first seam 48 and second seam 50 lie within the nominal planar box 36.

Figure 4E:
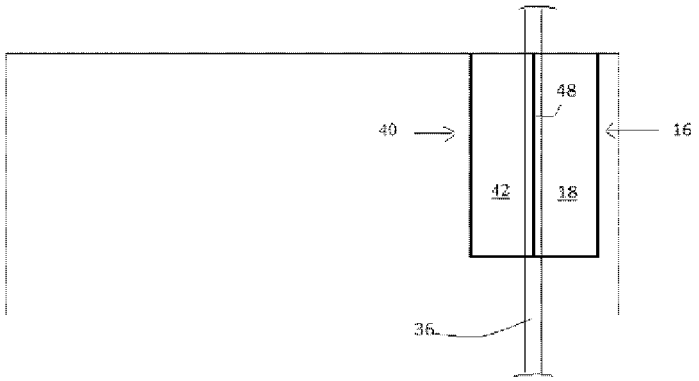
FIG. 4E shows a cross section marked as A-A in FIG. 4D.

A cross section marked as A-A in FIG. 4D is shown in FIG. 4E. The cross section can be considered to be taken at half the thickness of the wall panels 18 and 42. Typical thicknesses of drywall boards in North America are three-eighths of an inch, one-half of an inch or five-eighths of an inch. It will be noted that the first seam 48 lies within the nominal planar box 36. (Only the part 60 of the first seam 48, formed between the first wall panel 18 and the third wall panel 42, is shown in FIG. 4E; the other part 64 of the first seam 48 is not shown in this cross section.)

Figure 4F:
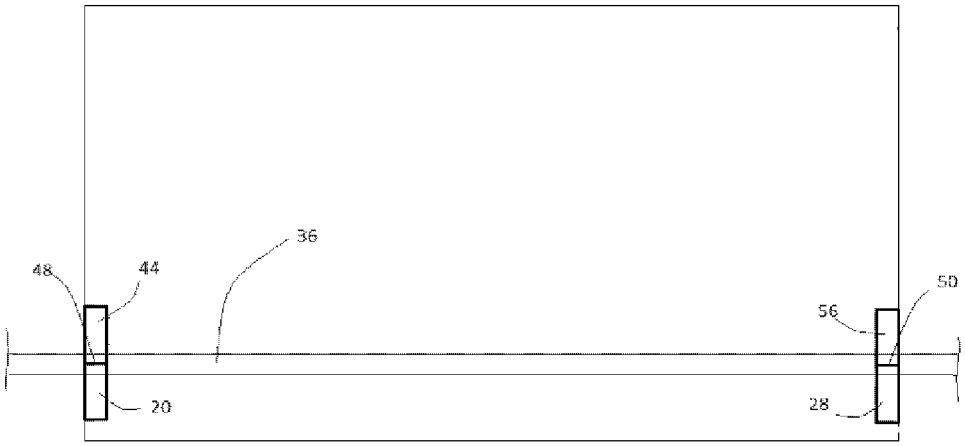
FIG. 4F shows a cross section marked as B-B in FIG. 4D.

A cross section marked as B-B in FIG. 4D is shown in FIG. 4F. The cross section can be considered to be taken at half the thickness of the ceiling panels 20, 28, 44 and 56.

Figure 4G:
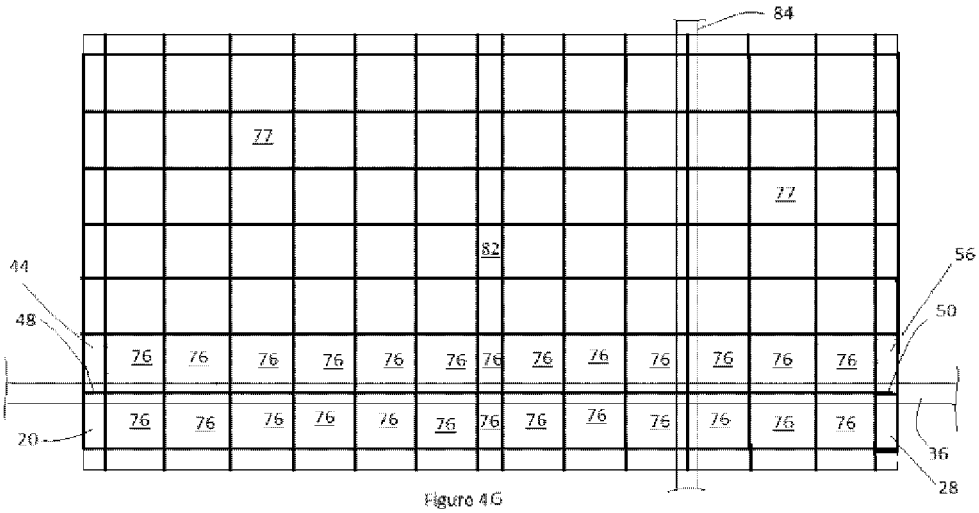
FIG. 4G shows other ceiling boards secured to the ceiling framing, according to the principles of the present invention.

With reference to FIG. 4G, other ceiling boards 76 can be secured to the ceiling framing 14 so that the seams between the first seam 48 and the second seam 50 continue to lie within the planar box 36. The ceiling boards 76 span the space between the first ceiling panel 20 and the second ceiling panel 28. The ceiling boards 76 also span the space between the third ceiling panel 44 and the fourth ceiling panel 56. Other representative ceiling boards 77 are also shown in FIG. 4G.

Figure 4H:
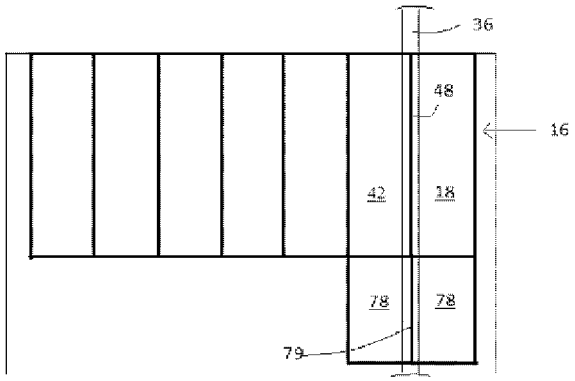
FIG. 4H shows other wall boards secured to the wall framing, according to the principles of the present invention.
Figure 41:
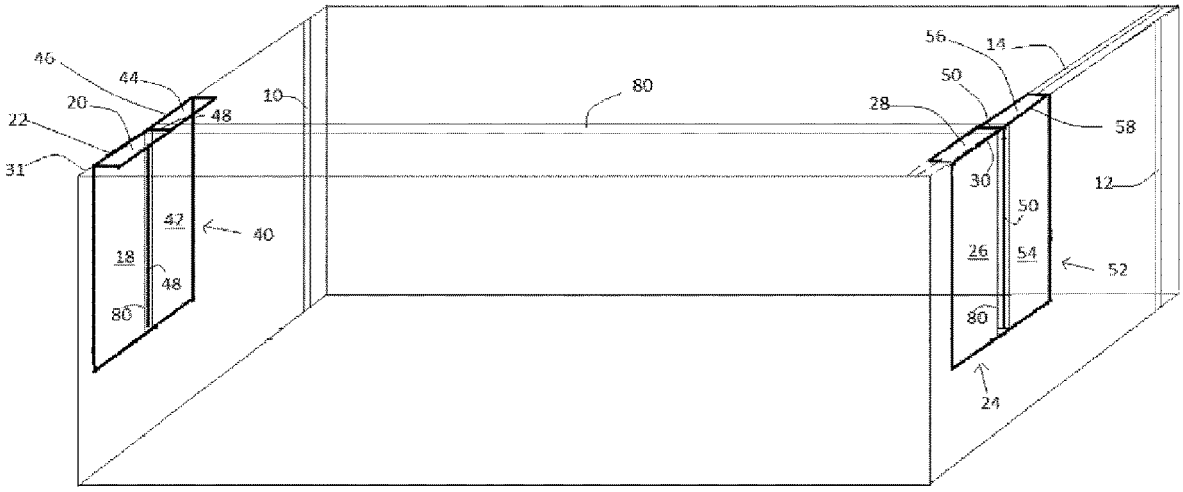

In a similar fashion, and with reference to FIG. 4H, other wall boards 78 can be secured to the wall framing so that seam(s) 79 continue to lie within the planar box 36. The wall boards 78 span the space between the floor or baseboard and the bottom of the first wall panel 18, the bottom of the third wall panel 42, the bottom of the second wall panel 26 (not shown) and the bottom of the fourth wall panel 54 (not shown).

With reference to FIG. 4I, drywall compound (not shown) and tape 80 can be applied to the part 60 of the first seam 48 located on the first wall portion 62, the part 64 of the first seam 68 located on the first ceiling portion 66, the part 68 of the second seam 50 located on the second wall portion 70 and the part 72 of the second seam 50 located on the second ceiling portion 74. The tape 80 can be applied in a continuous ribbon (in the shape of an upside down "U") because the seams lie within the planar box 36 whose thickness is smaller than the width of the tape 80. It should be understood that the ribbon can traverse all of the seams within a particular planar box, including the seams formed by the wall boards (not shown in FIG. 4I), the wall panels (between panels 18 and 42, and between panels 26 and 54, for instance), ceiling boards 76 (not shown in FIG. 4I), and ceiling panels (between panels 20 and 44, and between panels 28 and 56, for instance). Such seams run up a wall across the ceiling and down the opposite wall within the planar box 36.

Thus, in application, the drywall tape runs continuously along a series of seams that are all within a planar box, from the floor/baseboard, up along the wall, across the ceiling and down the opposite wall.

As shown in FIGS. 4G and 4H, this process can be repeated by securing other drywall panels to the first wall framing 10 to form a first wall, the second wall framing 12 to form a second wall and the ceiling framing 14 to form a ceiling. For each seam formed between adjacent drywall panels on the first wall framing, there is a corresponding opposite seam formed between adjacent drywall panels on the opposite second wall framing 12. According to the principles of the present invention, each such seam and corresponding opposite seam lie within a respective nominal planar box of width two inches, for example. Seam(s) spanning the ceiling also lie in the respective planar box.

The distance between the first seam 48 (and the associated first planar box containing it) and the nearest wall can vary. In one embodiment based on North American standard sizing for drywall widths and stud framing, the first planar box can lie 16 inches from a wall parallel thereto, as measured from the center of the thickness of the planar box. Parallel to and spaced apart from the first seam will lie another seam contained in another associated planar box, and so on. In particular, this other planar box can lie 48 inches from the first planar box. Additional planar boxes could also lie 48 inches apart. Starting from the opposite wall, this spacing is repeated, moving from the walls towards the center of the room. It may be necessary to have an exceptional spacing between the two planar boxes near the center of the room to account for the board that fills the space that remains. Board 82 of FIG. 4G is an exceptional board that fills such an exceptional spacing.

Planar boxes may also be disposed perpendicular to each other. Thus, in a room containing four walls, one group of at least three seams can run up a first wall, across the ceiling and down a second, opposite wall, while another group of at least three seams can run up a third wall (perpendicular to the first wall), across the ceiling and down a fourth, opposite wall (perpendicular to the second wall). Any two planar boxes can either be parallel to each other or perpendicular to each other. In FIG. 4G, planar box 36 is perpendicular to planar box 84, for example. For clarity, only two planar boxes, 36 and 84, are shown. It should be understood that in FIG. 4G, five pertinent planar boxes, parallel to planar box 36, have been omitted, and eleven pertinent planar boxes, parallel to planar box 84, have also been omitted. The planar boxes are form a perpendicular grid. Within each planar box lie a wall seam (such as part 60, a seam formed between the first wall panel 18 and the third wall panel 42), another opposite wall seam (such as part 68, a seam formed between the second wall panel 26 and the fourth wall panel 54) and at least one ceiling seam (such as part 64, a seam formed between the first ceiling panel 20 and the third ceiling panel 44, and part 72, as seam formed between the second ceiling panel 28 and the fourth ceiling panel 56) therebetween. Depending on the dimensions of the room, other seams can lie within their respective planar boxes.

Figure 5:
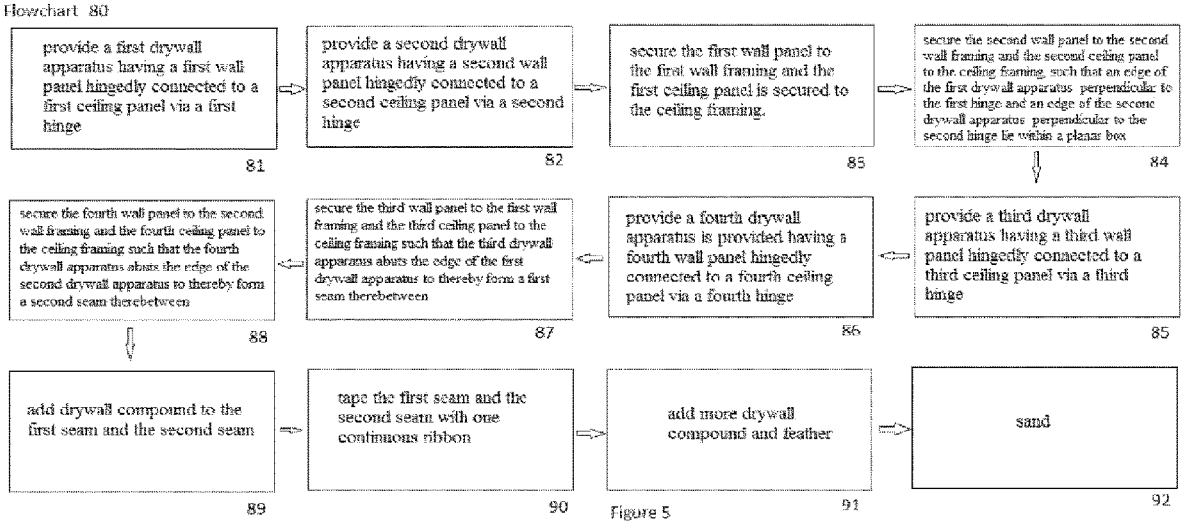
FIG. 5 shows a flowchart for a method of installing drywall in a room, according to principles of the present invention.

In FIG. 5, a flowchart 80 is shown providing steps in a method of installing drywall in a room containing a first wall framing, an opposite second wall framing and a ceiling framing, according to the principles of the present invention. The method includes the step 81 of providing a first drywall apparatus having a first wall panel hingeably connected to a first ceiling panel via a first hinge and the step 82 of providing a second drywall apparatus having a second wall panel hingeably connected to a second ceiling panel via a second hinge. In step 83, the first wall panel is secured to the first wall framing and the first ceiling panel is secured to the ceiling framing. Likewise, in step 84, the second wall panel is secured to the second wall framing and the second ceiling panel is secured to the ceiling framing, such that an edge of the first drywall apparatus perpendicular to the first hinge and an edge of the second drywall apparatus perpendicular to the second hinge lie within a nominal planar box.

In step 85, a third drywall apparatus is provided having a third wall panel hingeably connected to a third ceiling panel via a third hinge, and in step 86, a fourth drywall apparatus is provided having a fourth wall panel hingeably connected to a fourth ceiling panel via a fourth hinge. In step 87, the third wall panel is secured to the first wall framing and the third ceiling panel is secured to the ceiling framing such that the third drywall apparatus abuts the edge of the first drywall apparatus to thereby form a first seam therebetween. In step 88, the fourth wall panel is secured to the second wall framing and the fourth ceiling panel is secured to the ceiling framing such that the fourth drywall apparatus abuts the edge of the second drywall apparatus to thereby form a second seam therebetween. The first seam and the second seam lie within the nominal planar box.

In step 89, drywall compound is added to the first seam and the second seam. And in step 90, the first seam and the second seam are taped with one continuous ribbon. In step 91, more drywall compound is added and feathered, followed by sanding in step 92. The last two steps are repeated as necessary to achieve a finished look.

It will be appreciated that the number of planar boxes associated with a room can vary. Consider a small room where only four drywall apparatuses, with corner offsets, and one central ceiling board is required. In such a configuration only four planar boxes arise. Small rooms and large panels and boards tend to decrease the number of pertinent planar boxes that arise in a room.

Several advantages are associated with the drywall apparatus and the method of orientating the boards and panels described in the foregoing that are consistent with the principles of the present invention. It will be appreciated that by ensuring the seams run up one wall, across the ceiling and down the opposite wall within one planar box, it is possible to mud, tape and sand along approximately one plane with the concomitant savings in time and effort. In particular, in conventional applications, seams along walls and ceilings are somewhat haphazardly formed necessitating that workers move in an ad hoc fashion from seam to seam as they cut drywall tape from board to board and apply drywall compound. According to the principles of the present invention, because a group of seams is confined to a planar box, installers can move more efficiently when applying tape, mudding and sanding.

Moreover, assuming the thickness of the planar box is not greater than the width of the drywall tape used, it is not necessary to cut the drywall tape when applying the tape along the seams within the planar box. Instead, a continuous ribbon of drywall tape can be used on the set of seams within the planar box. This saves time and effort. As the width of drywall tape can vary, so too can the thickness of the nominal planar box that should be used. In a preferred embodiment, the thickness of the planar box can be less than two inches corresponding to the fact that conventional drywall tape in North America is often two inches wide. Other thicknesses as appropriate may also be used.

The foregoing advantages also ensue if the planar "box" has a thickness of zero, in which case we have a plane. This idealized planar "box" implies that all seams within a group lie exactly on one plane. In practice, due to slight framing imperfections, small variation in board lengths, etc., it is impossible to achieve this idealization. The non-zero thickness of the planar box adds some leeway, including to account for these imperfections.

In a different embodiment of the present invention, it is not necessary to use a drywall apparatus that has panels connected by a hinge. Instead, regular drywall boards can be used to construct walls and ceilings according to the principles of the present invention.

Figure 6A:
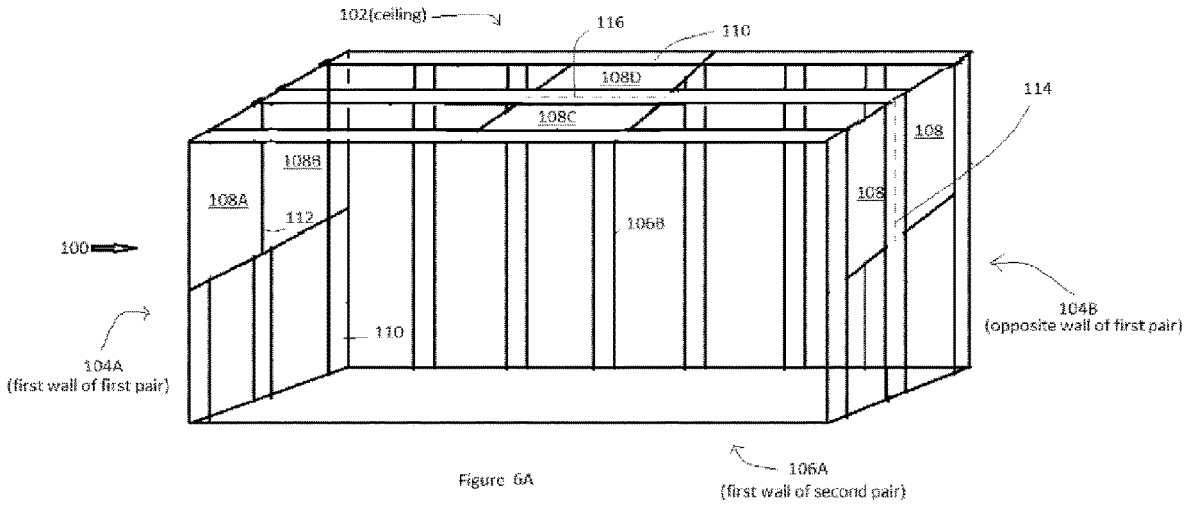
FIG. 6A shows a different embodiment of the instant invention in which non-hinge able drywall boards are used for installation in a room.

In particular, and with reference to FIG. 6A, drywall may be installed in a room 100 to form a ceiling 102 and two pairs of opposite walls. The first pair is labelled 104A and 104B. The second pair is labeled 106A and 106B. Drywall boards 108 may be affixed to framing 110 to create non-corner drywall seams formed by abutting pairs of boards that are not perpendicular. A seam is the line that forms between two adjacent drywall boards, such as boards 108A and 108B, that are abutted. If the boards abut in a non-planar fashion, typically the case where the two planes of the boards are perpendicular, this is said to be a corner seam. A corner seam usually arises where two perpendicular walls meet or where a wall and a ceiling meet. A non-corner seam arises where two boards abut substantially co-planarly, such as the vertical seam that arises on a wall when two substantially coplanar boards are abutted on the wall. A non-corner horizontal seam can also arise on a ceiling where two substantially coplanar boards, such as ceiling boards 108C and 108D, are affixed side-by-side on a ceiling. FIG. 6A only shows six drywall boards, but it should be understood that other drywall boards are needed to fill out the walls and ceiling.

The method of installing drywall in the room 100 involves forming the ceiling 102 and at least one pair of opposite walls 104A and 104B comprising securing drywall boards 108 to framing 110 to create non-corner drywall seams. The non-corner seams in the room 100 can be partitioned into groups, each group containing at least three non-corner seams consisting of a wall seam 112, an opposite wall seam 114 and at least one ceiling seam 116 between the wall seam 112 and opposite wall seam 114.

It will be appreciated that the seams 112, 114 and 116 form parts of an "upside down U": the wall seam 112 and opposite wall seam 114 lie on the vertical legs of the upside-down U, and the ceiling seam 116 lies on the horizontal section of the upside-down U with the ceiling seam 116 lying between the wall seam 112 and the opposite wall seam 114.

Figure 6B:
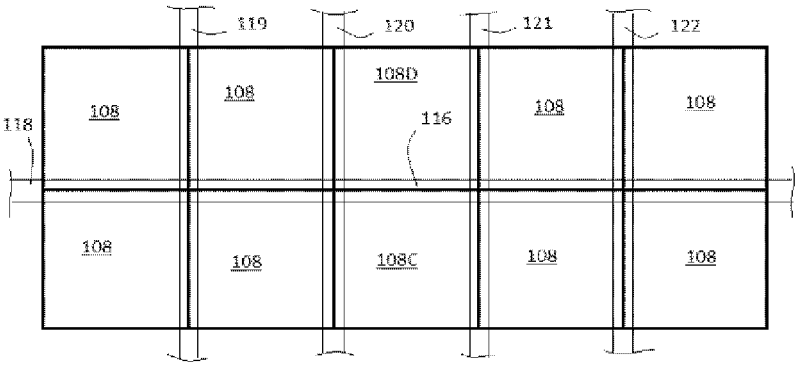
FIG. 6B is a plan view of FIG. 6A with ceiling boards added.

With reference to FIG. 6B, which is a top view of FIG. 6A with ceiling boards added but framing omitted for clarity, each group of at least three seams is associated with a respective nominal planar box. Five such groups are associated with respective planar boxes 118-122 shown in FIG. 6B.

Take, for example, the group associated with planar box 118. As can be seen from FIG. 6B, this group contains five ceiling seams, including seam 116. In addition, as shown in FIG. 6A, this group contains the wall seams 112 and 114. This group might also contain more wall seams if more wall boards are used below boards 108A and 108B, and below the pair of wall boards opposite these two boards (marked as 108 in FIG. 6A). Note that in the embodiment shown in FIGS. 6A and 6B, all these seams lie on a plane within the one planar box lie. The principles of the present invention call for the seams within a group to lie within a planar box and not necessarily to lie on a plane. As mentioned above, this provides some leeway during the installation of the boards while still offering the advantage that all seams within a planar box could be taped with a continuous ribbon of drywall tape, as long as the thickness of the planar box is less than the width of the drywall tape used.

Another group of seams is associated with planar box 119, which is perpendicular to planar box 118. This other group has two ceiling seams and, provided the same number of wall boards are in play, the same number of wall seams as lie in the planar box 118.

This last qualification about the number of wall boards deserves further explanation. In many applications, walls are not uniform, but rather are interrupted by windows, doors and the like. Ceilings, too, may possess "obstacles" such as a skylight. Nevertheless, according to the principles of the present invention, it is advantageous to orient as many seams as possible so that they form groups of at least three seams, each group associated with a respective planar box.

The non-corner seams are produced in the room so that the seams can be partitioned into a plurality of groups. Each group contains three non-corner seams consisting of a wall seam, an opposite wall seam and a ceiling seam tending to span the two wall seams. In addition, each group is associated with a respective nominal planar box of appropriate thickness, such as one and one-half inches. The three non-corner seams contained in each group lie within the associated nominal planar box. It should be understood that because of the leeway made available by the thickness of the planar box, the three non-corner seams need not be coplanar, although they can be.

In a preferred embodiment, in the construction of a room, all groups of at least three seams—a first seam running up one wall, an opposite seam running up an opposite wall and the at least one seam therebetween—lie within a respective planar box to facilitate the treatment of as many seams as possible.

It will be appreciated that by ensuring the seams run up one wall, across the ceiling and down the opposite wall within one planar box, it is possible to mud, tape and sand along approximately one plane. Because by design the thickness of the planar box is no larger than the width of the drywall tape used for taping the seams, it is not necessary to cut the tape to span all of the at least three non-corner seams. Because seams are substantially aligned within their groups, the process of installing and finishing drywall to form a room is simplified.

Figure 7:
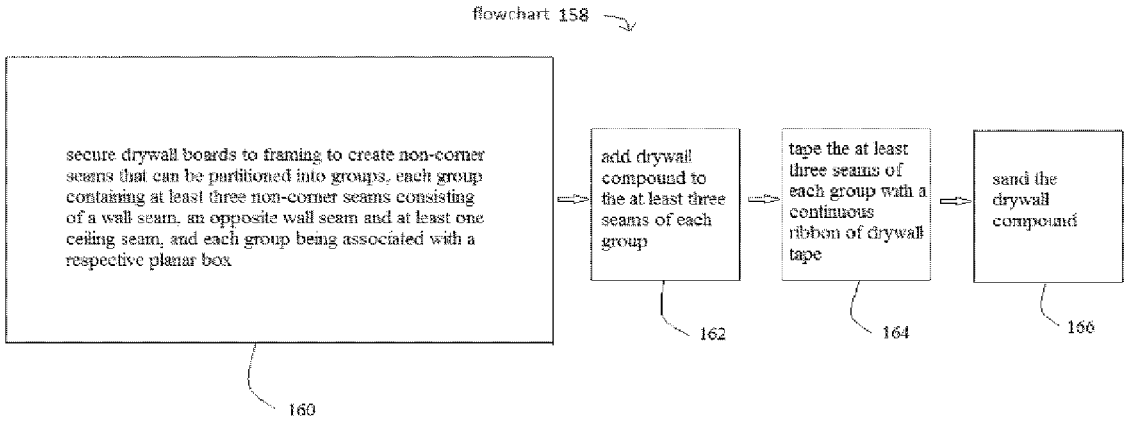
FIG. 7 shows a flowchart providing steps in a method of installing drywall in a room to form a ceiling and at least one pair of opposite walls, according to the principles of the present invention.

In FIG. 7, a flowchart 158 is shown providing steps in a method of installing drywall in a room to form a ceiling and at least one pair of opposite walls, according to the principles of the present invention.

The method includes the step 160 of securing drywall boards to framing to create non-corner drywall seams. Non-corner seams arise when two drywall boards that are not perpendicular to each other are abutted along edges. For example, where two boards affixed to a flat ceiling meet along two of their edges, a non-corner seam results that is horizontal.

The drywall boards are secured so that the non-corner seams in the room can be partitioned into groups, each group containing at least three non-corner seams consisting of a wall seam, an opposite wall seam and at least one ceiling seam between the wall seam and the opposite wall seam. Each group is associated with a respective nominal planar box wherein the at least three non-corner seams contained in each group lie within the respective nominal planar box associated therewith.

In step 162, drywall compound is added to the at least three seams of each group. In step 164, the at least three seams of each group are taped with a continuous ribbon of drywall tape. After the drywall compound dries, in step 166, the drywall compound is sanded. Steps 162 to 166 are repeated if necessary to achieve a clean, flat look with the goal of making the seams substantially imperceptible.

Figure 8:
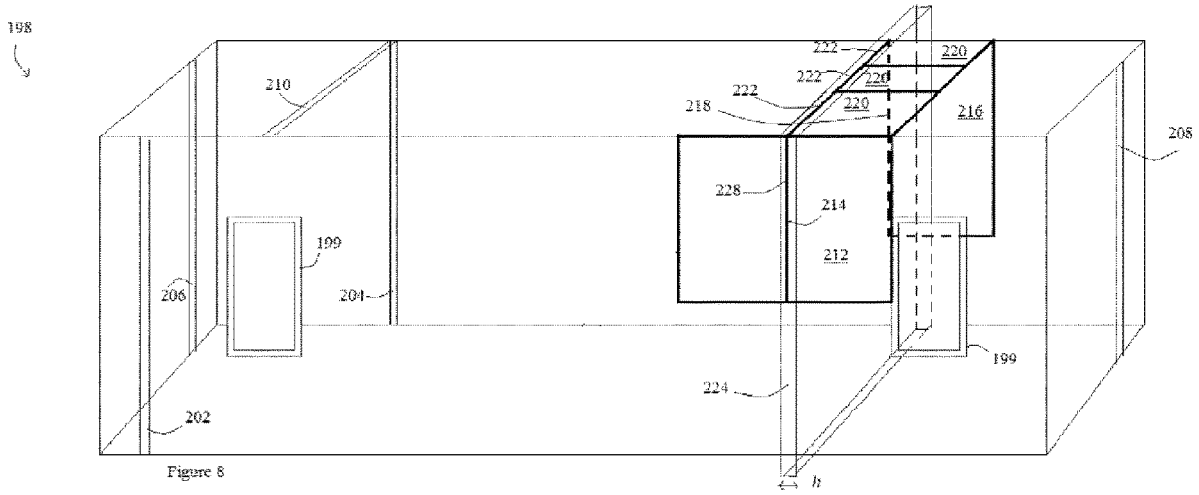
FIG. 8 shows elements for installing drywall in a room containing two windows, according to the principles of the present invention.
Figure 9:
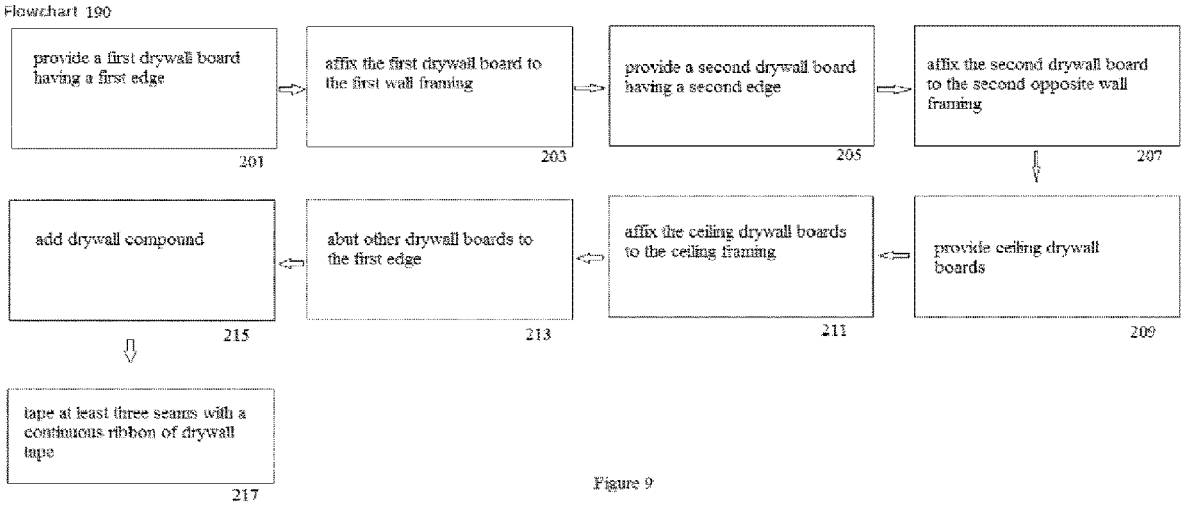
FIG. 9 is a flowchart providing steps in a method of installing drywall in a room containing two windows, according to the principles of the present invention.

With reference to FIGS. 8 and 9 (flowchart 190), a method of installing drywall in a room 198 containing two windows 199, a first wall framing 202, a second opposite wall framing 204, a third wall framing 206, a fourth opposite wall framing 208 and a ceiling framing 210 is provided. In step 201, a first drywall board 212 having a first edge 214 is provided. In step 203, the first drywall board 212 is affixed to the first wall framing 202, such that the first drywall board 212 is displaced from both the third wall framing 206 and the fourth opposite wall framing 208. Thus, the first edge 214 is not a corner edge that abuts the third wall built on the third wall framing, or abuts the fourth wall built on the fourth wall framing. In step 205, a second drywall board 216 having a second edge 218 is provided. In step 207, the second drywall board 216 is affixed to the second opposite wall framing 204, such that the second drywall board 216 is displaced from both the third wall framing 206 and the fourth opposite wall framing 206. In step 209, ceiling drywall boards 220 are provided, each having a ceiling edge 222. In step 211, the ceiling drywall boards 220 are affixed to the ceiling framing 210 so that the ceiling drywall boards 220 extend from the first drywall board 212 to the second drywall board 216. The first edge 214, the second edge 218 and each of the ceiling edges 222 lie within a nominal planar box 224 having a thickness h less than or equal to four inches.

In step 213, other drywall boards, such as drywall board 226, are abutted to the first edge 214, the second edge 218 and the ceiling edges 222 to form seams 228 between the other drywall boards and the first drywall board 212, the second drywall board 216 and the ceiling drywall boards 220, wherein the seams 228 lie within the nominal planar box 224.

In step 215, drywall compound is added to the seams 228 and in step 217, the at least three seams of each group are taped with a continuous ribbon of drywall tape.

Those of ordinary skill in the art will appreciate that a number of variations may be made in the disclosed embodiments, all without departing from the scope of the invention, which is defined solely by the appended claims. For example, although reference has been made to the installation of drywall boards to construct four walls in a room, it should be understood that the principles of the instant invention can be applied when this number is less than four either because the room only has three or fewer walls, or because the room has some walls constructed out of other material like metal, glass, screen, cloth, etc.

What is claimed herein is:

1. A method of installing drywall in a room containing a first wall framing, an opposite second wall framing and a ceiling framing, the method comprising:

providing a first drywall apparatus having a first wall panel hingeably connected to a first ceiling panel via a first hinge;

providing a second drywall apparatus having a second wall panel hingeably connected to a second ceiling panel via a second hinge;

securing the first wall panel to the first wall framing and the first ceiling panel to the ceiling framing; and securing the second wall panel to the second wall framing and the second ceiling panel to the ceiling framing, such that an edge of the first drywall apparatus perpendicular to the first hinge and an edge of the second drywall apparatus perpendicular to the second hinge lie within a nominal planar box having a first dimension, a second dimension and a third dimension that are mutually perpendicular, such that the first dimension has a length that increases without bound in both directions, the second dimension has a width that increases without bound in both directions and the third dimension has a thickness of less than or equal to four inches.

2. The method of claim 1, further comprising:

providing a third drywall apparatus having a third wall panel hingeably connected to a third ceiling panel via a third hinge;

providing a fourth drywall apparatus having a fourth wall panel hingeably connected to a fourth ceiling panel via a fourth hinge;

securing the third wall panel to the first wall framing and the third ceiling panel to the ceiling framing such that the third drywall apparatus abuts the edge of the first drywall apparatus to thereby form a first seam therebetween; and securing the fourth wall panel to the second wall framing and the fourth ceiling panel to the ceiling framing such that the fourth drywall apparatus abuts the edge of the second drywall apparatus to thereby form a second seam therebetween, wherein the first seam and the second seam lie within the nominal planar box.

3. The method of claim 2, wherein the first seam and the second seam lie on a plane.

4. The method of claim 3, further comprising: adding drywall compound to the first seam and the second seam; and taping the first seam and the second seam with one continuous ribbon of drywall tape.

5. The method of claim 2, wherein a part of said first seam, formed between the first wall panel and the third wall panel, is located on a first wall portion and another part of said first seam, formed between the first ceiling panel and the third ceiling panel, is located on a first ceiling portion, and wherein a part of said second seam, formed between the second wall panel and the fourth wall panel, is located on a second wall portion and a part of the second seam, formed between the second celling panel and the fourth ceiling panel, is located on a second ceiling portion, further comprising taping the part of said first seam located on the first wall portion, the part of said first seam located on the first ceiling portion, the part of said second seam located on the second wall portion and the part of the second seam located on the second ceiling portion with a continuous ribbon of drywall tape.

6. The method of claim 2, further comprising:

providing other drywall apparatuses containing wall panels hingeably connected to ceiling panels via hinges;

securing the ceiling panels of the other drywall apparatuses to the ceiling framing;

securing the wall panels of some of the other drywall apparatuses to the first wall framing to form a first wall, and of a remaining number of the other drywall apparatuses to the second wall framing to form a second wall thereby forming seams between the wall panels that are adjacent, such that for each seam formed between the wall panels that are adjacent on the first wall framing, there is a corresponding opposite seam formed between the wall panels that are adjacent on the opposite second wall framing; and securing ceiling drywall boards to the ceiling framing thereby forming ceiling seams between the ceiling drywall boards, such that at least one ceiling seam runs between each seam formed between the wall panels and corresponding opposite seam formed between the wall panels, and such that said each seam, said corresponding opposite seam and said at least one ceiling seam running therebetween form a group of seams, wherein each said group of seams lies within a respective nominal planar box of width less than or equal to four inches.

7. The method of claim 6, further comprising:

adding drywall compound to each group of seams; and taping each group of seams within the respective nominal planar box with one respective continuous ribbon of drywall tape.

8. The method of claim 1, wherein the thickness is less than or equal to one inch.

9. A method of installing drywall in a room to form a ceiling and at least one pair of opposite walls comprising:

securing drywall boards to framing to create non-corner drywall seams formed by abutting pairs of drywall boards that are not perpendicular, wherein the non-corner drywall seams can be partitioned into a plurality of groups, each group a) containing at least three non-corner seams consisting of a wall seam, an opposite wall seam and at least one ceiling seam and b) being associated with a respective nominal planar box having a first dimension, a second dimension and a third dimension that are mutually perpendicular, such that the first dimension has a length that increases without bound in both directions, the second dimension has a width that increases without bound in both directions and the third dimension has a thickness of less than or equal to 4 inches, wherein the at least three non-corner seams contained in each group lie within the respective nominal planar box associated therewith;

adding drywall compound to the at least three seams of each group; and taping the at least three seams of each group with a continuous ribbon of drywall tape.

10. The method of claim 9, wherein the at least three seams of each group are coplanar.

11. The method of claim 9, further comprising, after the drywall compound dries, sanding the drywall compound.

12. The method of claim 9, wherein the thickness is less than or equal to one inch.

13. A method of installing drywall in a room containing a first wall framing, a second opposite wall framing, a third wall framing, a fourth opposite wall framing and a ceiling framing, the method comprising:

providing a first drywall board having a first edge;

affixing the first drywall board to the first wall framing, such that the first drywall board is displaced from both the third wall framing and the fourth opposite wall framing;

providing a second drywall board having a second edge;

affixing the second drywall board to the second opposite wall framing, such that the second drywall board is displaced from both the third wall framing and the fourth opposite wall framing; and providing ceiling drywall boards, each having a ceiling edge; and affixing the ceiling drywall boards to the ceiling framing so that said ceiling drywall boards extend from the first drywall board to the second drywall board, wherein the first edge, the second edge and each of the ceiling edges lie within a nominal planar box having a first dimension, a second dimension and a third dimension that are mutually perpendicular, such that the first dimension has a length that increases without bound in both directions, the second dimension has a width that increases without bound in both directions and the third dimension has a thickness of less than or equal to four inches;

abutting other drywall boards to the first edge, the second edge and the ceiling edges to form seams between the other drywall boards and the first drywall board, the second drywall board and the ceiling drywall boards, wherein the seams lie within the nominal planar box;

adding drywall compound to the seams; and taping the seams with a continuous ribbon of drywall tape.

* * * * *